United States Patent [19]

Hattem et al.

[11] Patent Number: 4,688,350

[45] Date of Patent: Aug. 25, 1987

[54] COLLAPSIBLE REVOLVING DOOR

[75] Inventors: Marwan E. Hattem, Monroe; Calvin R. Rushford, Reed City, both of Mich.

[73] Assignee: Tubelite Division of Indall, Inc., Reed City, Mich.

[21] Appl. No.: 892,142

[22] Filed: Jul. 29, 1986

[51] Int. Cl.[4] ..... E05D 15/02

[52] U.S. Cl. ..... 49/44; 49/141

[58] Field of Search ..... 49/44, 141, 45

[56] References Cited

U.S. PATENT DOCUMENTS

| | | | |
|---|---|---|---|
| 1,536,196 | 5/1925 | Dyer | 49/44 |
| 1,886,502 | 11/1932 | Shields | 49/44 |
| 1,890,365 | 12/1932 | Blanchard | 49/44 |
| 1,963,881 | 6/1934 | Blanchard | 49/44 |
| 2,114,405 | 4/1938 | Shields | 49/44 |
| 2,539,750 | 1/1951 | Nordin | 49/44 |
| 3,766,686 | 10/1973 | Sheckells | 49/43 |

*Primary Examiner*—Philip C. Kannan

*Attorney, Agent, or Firm*—Varnum, Riddering, Schmidt & Howlett

[57] ABSTRACT

A revolving door (10) adapted to be mounted in a doorway to provide access and egress. The door (10) revolves about a vertical axis and has an upper cam housing (20) and a lower cam housing (22). Radial slots (24) extend through cam housings (20, 22). Pins (26) engage slots (24) and secure doorwings (12) to upper and lower cam housings (20, 22). A mechanism is mounted within at least one of cam housings (20, 22) for permitting doorwings (12) to be collapsed in panic situations or to accommodate large objects. At least one of the upper and lower cam housings has lateral bores (34) extending therethrough and intersecting the radial slots (24) at right angles. The mechanism for permitting the cam housings to be collapsed includes a cam mounted on each pin securing the doorwing to the cam housing and a spring-biased detent mechanism mounted within the lateral bore. This arrangement of the spring-biased detent mechanism within the lateral bore permits easy access to the detent mechanism for adjusting the pressure or force at which the doorwings collapse without the necessity of disassembling the revolving door.

13 Claims, 3 Drawing Figures

COLLAPSIBLE REVOLVING DOOR

FIELD OF THE INVENTION

The invention relates to revolving doors and, in particular, to four-wing doors adapted to be collapsed in panic situations.

BACKGROUND OF THE INVENTION

Revolving doors and, more particularly, revolving doors adapted to be collapsed in certain situations are well-known.

The U.S. Pat. No. 3,495,251 to Lowe (issued Feb. 10, 1970) discloses a collapsible revolving door wherein there are top and bottom cam housings, each having a central cam. The mechanism includes four cam followers (one for each door) held in position by spring biased ball detent mechanisms. Pins extend from ends of the cam followers adjacent the cam through radial slots in the cam housing. The ball in each detent mechanism presses against a ball socket in the circumferential wall of the central cam housing. Extraordinary force applied to the doorwings causes the ball in the detent mechanism to ride up out of the ball socket on the central cam housing and allows the doorwing to rotate about the axis of the pin extending from the end of the cam follower. The translational motion of the doorwing is guided by the pins which extend through radial slots. In a fully collapsed position, all four wings are parallel.

The Rush U.S. Pat. No. 3,736,701 (issued June 5, 1973) discloses a revolving door having a collapsing mechanism similar to that disclosed in the Lowe '251 Patent. In Rush, the upper and lower mechanisms are without a load bearing or torque transmitting central shaft. These mechanisms are coupled to the roof and floor of the doorway.

In the Lowe and Rush systems, the force at which the doors collapse is not easily adjustable. The mechanisms must be completely disassembled and new hardware provided in order to change the collapsing force.

The U.S. Pat. No. 2,111,182 to Hagenbook (issued Mar. 15, 1938) discloses a revolving door mechanism wherein radially positioned spring-biased reciprocatory plungers in central hubs engage rollers in each doorwing to maintain the wings in radial position. As pressure is applied to the door, the reciprocatory plunger retracts as it slides up over the roller to allow the wings to collapse. The spring force on the plungers appears to be adjustable through set screws but it appears that adjustment would require disassembly of the hardware.

The above-described revolving door mechanisms, do not provide for easy adjustment of the force at which the collapsing mechanisms collapse the doors. The top collapsing mechanism may be required in different environment to collapse the doors at different force levels.

SUMMARY OF THE INVENTION

According to the invention, a collapsible revolving door assembly is adapted to be positioned in a doorway having a roof and a floor. The door assembly is rotatable about a vertical axis. At least one cam housing has a plurality of radial slots extending therethrough and is mounted for rotation about the vertical axis in the roof or floor. A plurality of doorwings is mounted to the cam housing through pins which are secured nonrotatably thereto and which extend vertically through one of the slots in the cam housing. A collapsing means is mounted within the at least one cam housing for permitting the doorwings to be collapsed when subjected to unusual pressure while retaining the doorwings in radial position during normal usage.

According to the invention, the at least one cam housing has lateral bores extending therethrough and intersecting the radial slots. The collapsing mechanism further comprises a cam mounted nonrotatably on the pins for securing the doorwings to the cam housing and having a detent receiving means. A biased detent mechanism is mounted within the lateral bores and is engageable with the detent receiving means for releasably securing the cams in a given orientation within the cam housing.

Preferably, the detent receiving means comprises a vertical surface with an indentation therein and the detent mechanisms have a forward, converging surface thereon adapted to engage the indentation in the cam. Further, the radial slots in the at least one cam housing have surrounding cam grooves to receive the cams for guiding movement of the cams along the slots during collapsing movement. Preferably, the bias detent mechanism further comprises an adjustable plug threaded into the lateral bore for adjusting the bias on the detent mechanism and, in turn, for adjusting the pressure on the forward converging surface against the indentation in the cam, thereby adjusting the pressure at which the doorwings collapse. The collapsing mechanism is so designed so that the doorwings are parallel to each other when the doorwings are in the collapsed position.

In accordance with one embodiment of the invention, the cam surface and the cam slot have interengaging means diametrically opposite the cam indentation and the detent means, respectively, to resist rotation of the cams within the radial slots when the doorwings are radially oriented in the at least one cam housing.

Preferably, there are two cam housings, one positioned in the roof and one positioned in the floor. Each of the cam housing has an identical collapsing mechanism.

In accordance with a preferred embodiment of the invention, the lateral bores are at right angles to the radial slots. Further, the bias detent mechanism includes a compression coil spring which is adjusted by a threaded plug.

BRIEF DESCRIPTION OF THE DRAWINGS

The invention will now be described with reference to the drawings in which.

DETAILED DESCRIPTION OF THE INVENTION

Figure 1:
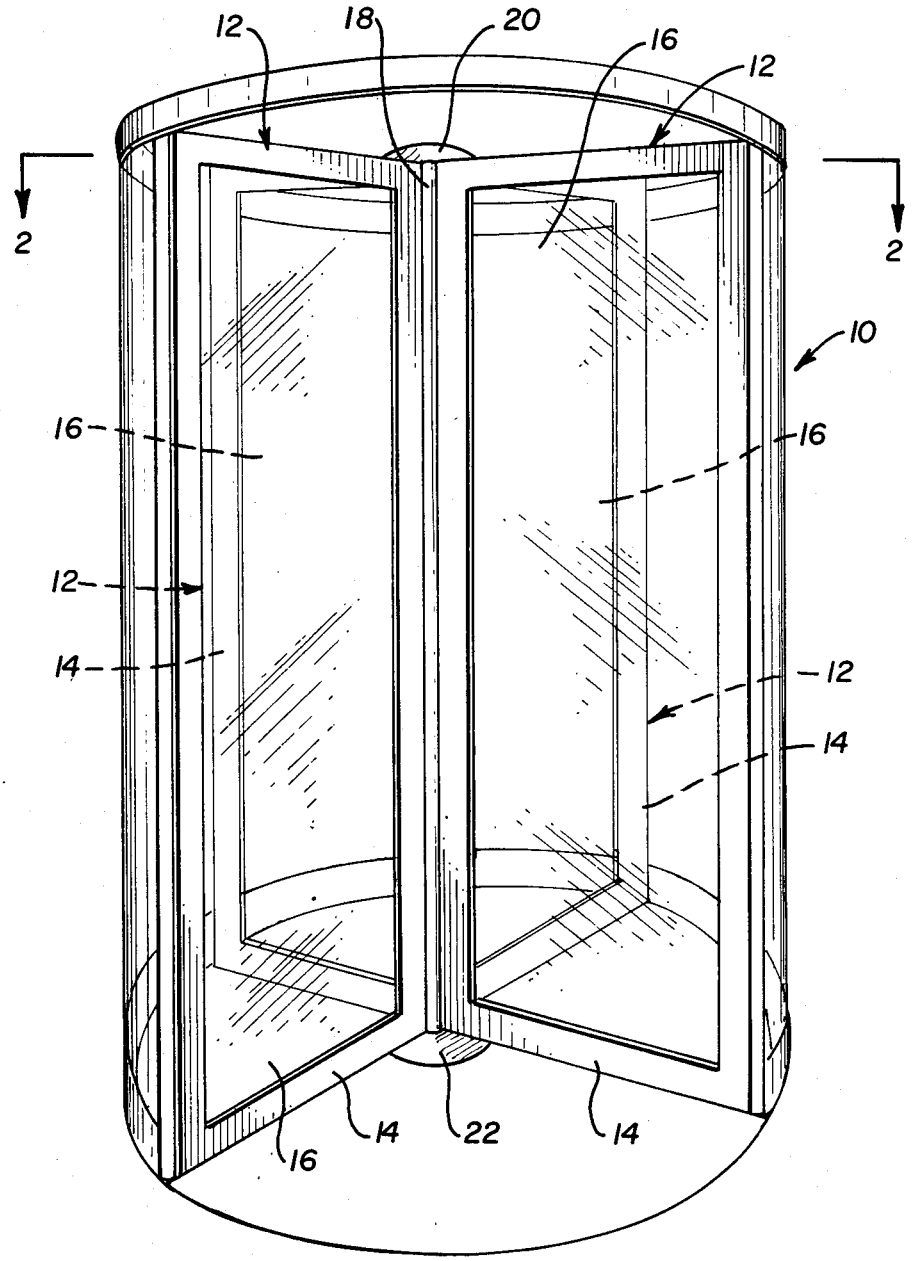
FIG. 1 is a perspective view of a revolving door according to the invention.

With reference to the drawings and, in particular, with reference to FIG. 1, there is shown a revolving door 10 according to the invention. The revolving door is adapted to provide access and egress to and from a building. The revolving door conserves heat and energy, and also prevents drafts, by maintaining a barrier between inside and outside environments at all times during normal use. Revolving door 10 comprises four door wings 12. Each wing 12 comprises a rectangular panel maintained in a vertical position. The vertical height of each wing is greater than the height of a typical user. The lateral width of each wing 12 is greater than the width of a typical user. Thus, each wing 12 is somewhat larger than a typical user of the revolving door 10. Each wing 12 comprises a frame 14 comprising a narrow metal strip extending around at least two sides of wing 12. Frame 14 engages a glass panel 16 and also provides a gasket adapted to seal with a side housing and with upper and bottom surfaces of a building in which revolving door 10 is mounted.

Glass panels 16 comprise rectangular glass panels of substantially the same shape and size of door wing 12. Each panel 16 is mounted within two-sided or four-sided frame 14. Glass panels 16 are visually pleasing and permit a user on one side of revolving door 10 to observe the opposite side of revolving door 10. In this manner, users may avoid attempting to rotate revolving door 10 in one direction while, at the same time, users on the opposite side of revolving door 10 attempt to rotate revolving door 10 in an opposite direction.

Wings 12 are mounted at right angles to each other about a centrally located shaft 18. Shaft 18 extends between an upper cam housing 20 and a lower cam housing 22.

Figure 2:
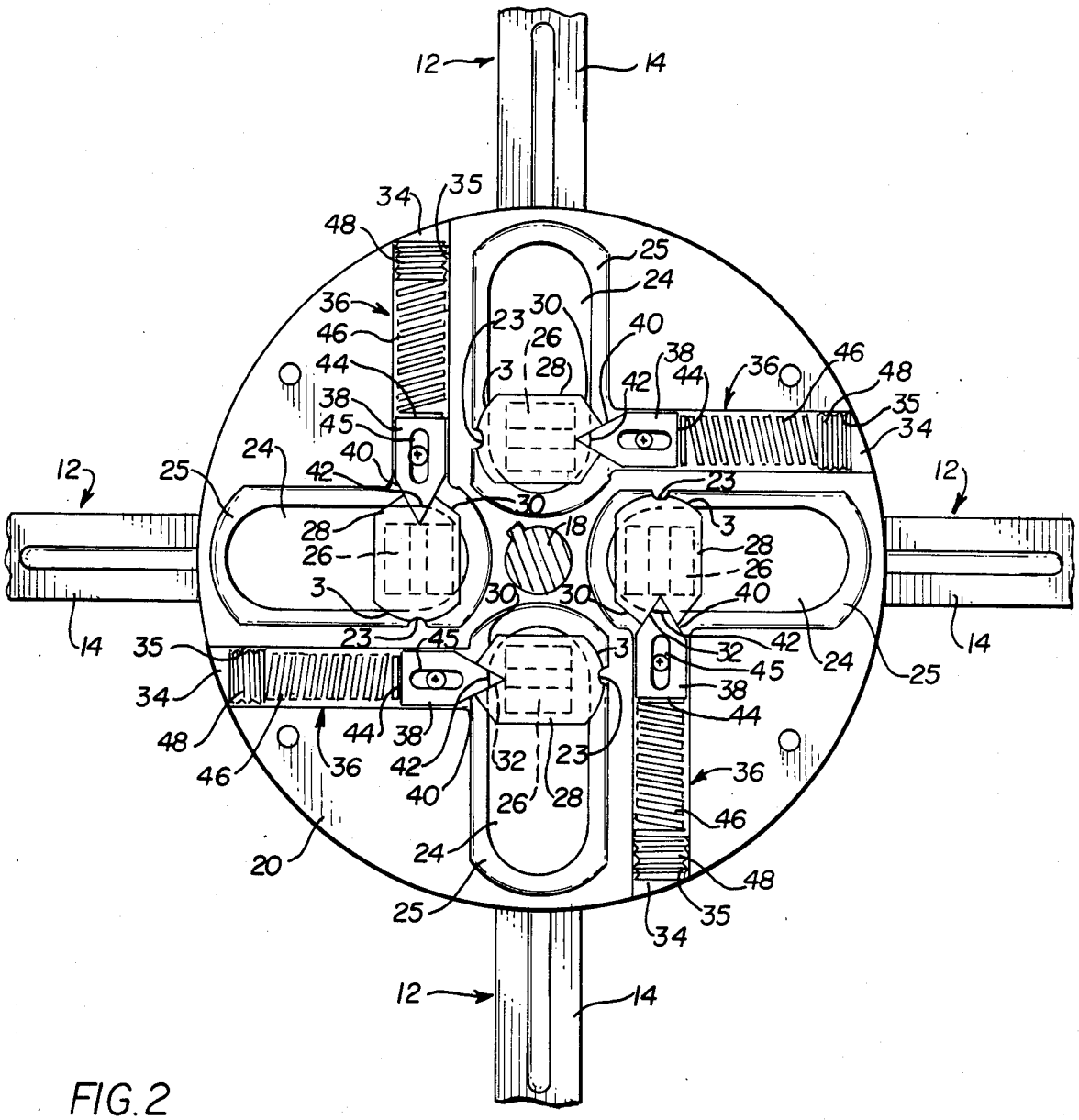
FIG. 2 is a sectional view taken along Line 2—2 of FIG. 1 showing four door wings in a normal, use position.
Figure 3:
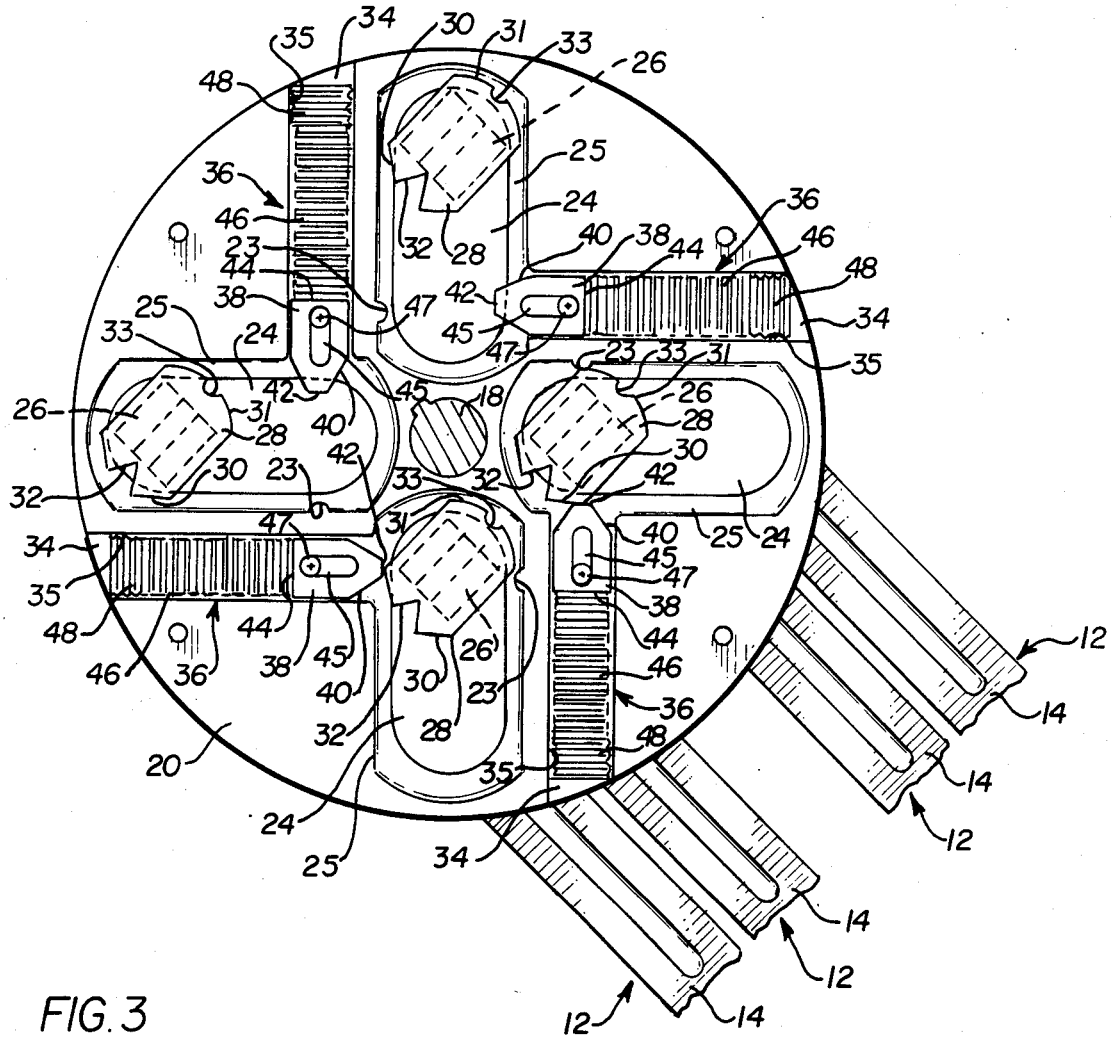
FIG. 3 is a sectional view like FIG. 2 showing four door wings in a collapsed position.

In normal use, access or egress to or from a building is achieved when the user enters revolving door 10 and presses against a door wing 12. As pressure is exerted against one door wing 12, all of the door wings 12, the upper cam housing 20 and the lower cam housing 22 rotate about shaft 18, which is jounalled in bearings (not shown). As the door 10 rotates, the user is thereby permitted to pass through the door 10. As may be seen in FIGS. 2 and 3, revolving door 10 is adapted to allow door wings 12 to be collapsed into a position where all door wings 12 are parallel. Thus, the door wings 12 can be pushed into a collapsed position to permit free passage through door 10 in a panic situation. In this manner, users can pass through door 10 without rotating door wings 12 in a one-at-a-time manner. This collapsing ability is particularly useful in panic situations such as fires, where many individuals will attempt to use revolving door at one time. In addition, the collapsibility of door wings 12 is advantageous in that it permits large objects to be moved through door 10 without interference by the door wings 12.

The cam housings 20, 22 are substantially identical. Cam housings 20 and 22 will now be described with reference to upper cam housing 20 as may be seen in FIGS. 2 and 3. Upper cam housing 20 comprises a circular disc of metal. Upper cam housing 20 serves as a body to which door wings 12 can be mounted. Upper cam housing 20 is non-rotatably fixed to shaft 18. Thus, as pressure is exerted against door wings 12, door wings 12 rotate together with cam housing 20 about the central longitudinal axis of shaft 18. Cam housing 20, in turn, rotates with shaft 18, which is jounalled in bearings (not shown). Thus, in normal use the door wings 12, upper housing 20 and shaft 18 rotate in unison, maintaining a perpendicular relationship between adjacent door wings 12.

Upper cam housing 20 comprises a disc having four radially extending slots 24 therethrough between the center of cam housing 20 and the periphery thereof. Larger surrounding cam grooves 25 surround each slot 24 and are adapted to permit cams 28 to ride there in above the slots 24. A vertical ridge or protuberance 23 extends into each cam groove 25. Cam grooves 25 are located at the top of upper cam housing 20 and are located on the bottom surface of lower cam housing 22. Rectangular pins 26 extend vertically from the upper and lower ends of each door wing 12 to cams 28. Each rectangular pin 26 is non-rotatably secured to the inner portion of each door wing 12 and extends through a corresponding slot 24 to connect door wing 12 to cam 28, thereby mounting door wing 12 to cam housings 20 and 22.

Cams 28 are non-rotatably mounted to rectangular pins 26 to secure rectangular pins 26 within slots 24. Preferably, each cam 28 and each corresponding rectangular pin 26 are formed as a single integral piece. Each cam 28 is adapted to ride within cam slot 25. Each cam 28 has a vertical surface 30 having a notch 32 therein and an opposing curved surface having a curved notch 33 therein adapted to mate with ridge 23. Lateral bores 34 extend between the periphery of cam housing 20 and the inner portion of each cam groove 25. Each lateral bore 34 intersects a cam groove at a right angle and has a threaded outer end portion 35.

A detent mechanism 36 is located within each lateral bore 34 and is adapted to secure cam 28 in a fixed position during normal use, while permitting rotation of cam 28 and translational movement of rectangular pin 26 during panic situations or when revolving door 10 is to be otherwise placed in the collapsed position. Each detent mechanism 36 comprises a cylindrical cam retainer 38 adapted to engage cam 28. Each cam retainer 38 comprises a converging surface at the forward portion thereof adapted to mate with notch 32 on cam 28. Each cam retainer has at its forward terminus a radiused end 42. A counter bored flat rear end 44 is located at the rear portion of each cam retainer 38. The counter bored flat rear end 44 is adapted to abut a biasing spring 46 and has a projecting spring retainer. Biasing spring 46 comprises a compression spring adapted to provide force to press cam retainer 38 against cam 28. Spring 46 is placed in compression between counter bored flat end 44 and a threaded counter bored adjustable plug 48. Plug 48 and cam retainer 38 are counter bored on faces adjacent to biasing spring 46 so that a forward end of biasing spring 46 fits inside the counter bored face of cam retainer 38 and a rear end of biasing spring 46 fits inside the counter bored face of plug 48. In this manner, spring 46 is maintained in the proper alignment between plug 48 and cam retainer 38. Adjustable plug 48 may be moved inward or outward in lateral bore 34 by turning plug 48. Plug 48 may be reached through the opening where lateral bore 34 reaches the periphery of cam housing 20. In this manner, the force with which cam retainer 38 is pressed against and into notch 32 may be adjusted.

Each cam retainer 38 has a recessed slot 45 therein adapted to engage an end of a set screw 47. Set screw 47 is threaded into cam housing 20 so that an end thereof extends into lateral bore 34 and into slot 45. Set screw 47 thereby retains cam retainer 38 within lateral bore 34 after door wings 12 have been collapsed into a parallel position.

In use, the force with which cam retainer 38 presses against and into notch 32 maintains cam 28 in a fixed position relative to cam housing 20. The cams are further retained in the fixed position by the protuberance 23 in the curved surface 31 of the cam housing cam groove 25. Thus, rectangular pin 26 and door wing 12 are also maintained in a fixed position relative to cam housing 20. Thus, in normal use, each door wing 12 is maintained in a fixed position relative to cam housing 20 and, in turn, in a fixed relationship relative to each remaining door wing 12.

As extraordinary force is exerted against a door wing 12 or as forces are exerted against two door wings 12 in an attempt to rotate door 10 in opposite directions simultaneously, cam retainer 38 rides laterally up notch 32, thereby depressing cam retainer 38 and biasing spring 46. At the same time, cam 28 pivots over ridge 23. In this manner, cam 28 is permitted to rotate within cam housing 20. In turn, rectangular pin 26 and door wing 12 rotate with respect to cam housing 20. Simultaneously rectangular pin 26 is permitted to move along slot 24 and cam 28 is permitted to move along cam groove 25. As may be seen in FIG. 3, revolving door 10 may thereby be collapsed into a position whereby all four door wings are in a collapsed parallel position. Door wings 12 are thereby placed in an out of the way position to permit free flow through door 10 during panic situations or to permit movement of large objects through the door.

Door wings 12 can be moved from a collapsed parallel position to the normal use position by manually rotating door wings 12 into the appropriate perpendicular position. When the door wings 12 are returned by their normal position illustrated in FIG. 2, the cams 28 will move along the slots 24 and rotate back to the initial position.

While particular embodiments of the invention have been shown, it will be understood that the invention is not limited thereto and reasonable modifications and variations are possible within the scope of the invention without departing from the spirit of the invention which is defined in the appended claims.

The embodiments of the invention in which an exclusive property or privilege is claimed are defined as follows:

1. In collapsible revolving door assembly adapted to be positioned in a doorway having a roof and a floor, the door assembly being rotatable about a vertical axis; at least one cam housing having a plurality of radial slots extending therethrough and mounted for rotation about said vertical axis in said roof or floor; a plurality of doorwings each having a pin secured nonrotably thereto and extending vertically through a respective one of said slots for mounting each of said doorwings to said cam housing; and a collapsing means mounted within said at least one cam housing for permitting said doorwings to be collapsed when subjected to abnormal pressure while retaining said doorwings in radial position during normal usage; the improvement which comprises:

said at least one cam housing having lateral bores extending therethrough and intersecting said radial slots; and said collapsing means comprising a cam mounted non-rotatably on said pins for securing said doorwing to said cam housing and having a detent receiving means, and detent mechanisms mounted within said lateral bore engageable with said detent receiving means for releasably securing said cams in a given orientation within said cam housing.

2. A revolving door assembly according to claim 1 wherein said cams have a vertical surface with an indentation therein; and said detent mechanisms have a forward, converging surface thereon adapted to engage said indentation in said cam.

3. A revolving door assembly according to claim 2 wherein said radial slots in said at least one cam housing have surrounding cam grooves to receive said cams for guiding movement of said cams along said slots during collapsing movement.

4. A revolving door assembly according to claim 3 wherein said detent mechanism further comprises means in said lateral bores to bias said forward converging surface against said can and an adjustable plug threaded in said lateral bore for adjusting the bias on said detent mechanism and, in turn, for adjusting the pressure of said forward converging surface against said indentation in said cam, thereby adjusting the pressure at which the doorwings collapse.

5. A revolving door assembly according to claim 4 wherein said cam vertical surfaces and said cam slot have interengaging means diametrically opposite said indentation to resist rotation of said cams within said radial slots when said doorwings are radially oriented in said at least one cam housing.

6. A revolving door assembly according to claim 5 wherein said interengaging means comprises an indentation in said vertical cam surface and a protuberance in said slot.

7. A revolving door assembly according to claim 1 wherein said detent mechanism has a biasing means which is adjustable so that the pressure at which the doorwings collapse may be adjusted without disassembly of said doorwing.

8. A revolving door assembly according to claim 7 wherein said spring-biased detent mechanism further comprises a threaded adjustable plug mounted in said lateral bore for adjusting the bias on said detent mechanism and, in turn, for adjusting the pressure of said biased detent mechanism against said cam, thereby adjusting the pressure at which the doorwings collapse.

9. A revolving door assembly according to claim 1 wherein each of said doorwings is parallel to each of the other of said doorwings when said doorwings are in the collapsed position.

10. A revolving door assembly according to claim 1 and further comprising interengaging means on said cams and said radial slots and opposite said detent receiving means to resist rotation of said cams within said radial slots when said doorwings are radially oriented in said at least one cam housing.

11. A revolving door assembly according to claim 1 wherein there is a cam housing in said roof and floor and each of said cam housings has a said collapsing means.

12. A revolving door assembly according to claim 1 wherein said detent mechanism includes a compression coil spring to bias said detent mechanism against said cam detent-receiving means.

13. A revolving door assembly according to claim 1 wherein said lateral bores are at right angles to said radial slots.

* * * * *